US005225801A

United States Patent [19]

Ida et al.

[11] Patent Number: 5,225,801

[45] Date of Patent: Jul. 6, 1993

[54] IGNITION COIL DEVICE FOR ENGINE

[75] Inventors: Yashuhiko Ida; Bortman T. Jung, both of Saitama, Japan

[73] Assignee: Toyo Denso Kabushiki Kaisha, Tokyo, Japan

[21] Appl. No.: 690,069

[22] Filed: Apr. 23, 1991

[30] Foreign Application Priority Data

| | | | |
|---|---|---|---|
| Apr. 28, 1990 | [JP] | Japan | 2-46353 |
| Apr. 28, 1990 | [JP] | Japan | 2-46354 |
| Apr. 28, 1990 | [JP] | Japan | 2-46355 |
| Apr. 28, 1990 | [JP] | Japan | 2-46356 |

[51] Int. Cl.[5] ..... H01F 27/04; H01F 15/10

[52] U.S. Cl. ..... 336/96; 336/92; 336/107; 336/192; 439/397

[58] Field of Search ..... 123/621, 634; 336/192, 336/105, 107, 92, 90, 198, 96; 439/396, 397, 399, 398, 400

[56] References Cited

U.S. PATENT DOCUMENTS

| | | | |
|---|---|---|---|
| 3,227,991 | 1/1966 | Zdanis | 439/397 |
| 4,116,522 | 9/1978 | Reynolds | 439/398 |
| 4,212,509 | 7/1980 | Brooks | 439/398 |
| 4,291,935 | 9/1981 | Badoz et al. | 439/399 |
| 4,721,935 | 1/1988 | Gunnels et al. | 336/192 |
| 4,918,419 | 4/1990 | Ida | 336/96 |
| 5,109,209 | 4/1992 | Ida et al. | 336/96 |

*Primary Examiner*—Thomas J. Kozma
*Attorney, Agent, or Firm*—Lyon & Lyon

[57] ABSTRACT

Disclosed is an engine igniting coil device which comprises a plurality of coil units arranged in a case and unitarily potted therein with thermosetting resin, and is characterized by that only when the coil units being mounted in the coil case, electrical connections at the primary and the secondary sides may be accomplished with the optimally treated primary and secondary wirings.

8 Claims, 10 Drawing Sheets

IGNITION COIL DEVICE FOR ENGINE

BACKGROUND OF THE INVENTION

The present invention relates to an engine ignition coil device.

Recently, there has been developed such an engine igniting coil device with comprises one coil case wherein a plurality of coil units selected in accordance with a quantity of engine cylinders are arranged with no use of a distributor and unitarily molded by potting with insulting material such as epoxy resin and the like.

In such an engine igniting coil device of prior art, wires leading from a primary coil and a secondary coil of each coil units mounted in the coil case are connected by the method of soldering or electric welding to a corresponding primary and secondary terminal pins previously attached to coil case.

However, soldering the large number of primary and secondary coil leads to the large number of primary and secondary terminal pins in a limited area in the coil case may not effectively performed and is apt to cause poor connections.

Furthermore, in such engine igniting device, to use a terminal pin in common for common terminals of primary coils, primary terminal pins for the coil units are arranged in group at the place of terminal base corresponding to a terminal coupler at the terminal base in the coil case, and terminal ends of the primary coils of the coil units and corresponding terminal pins are connected by use of lead elements arranged at the same terminal base which in turn is placed at a given position in the coil case.

In the prior art, wherein, as shown in FIG. 15, three coil units 1, 2, 3 are arranged in parallel to each other in a coil case (not shown), since connecting positions T11, T12, T21, T22, T23, T31, T32 whereto both terminals of primary coils of the coil units, are arranged at the same line, leads l1–l4 for connecting the terminal connecting points to the terminal pins P1–P4 have to cross with each other.

In FIG. 5, P4 is a common terminal pin for (+) side to which terminal connecting points T12, T22, T32 of the primary coils of the coil units are connected by means of the lead l4.

Multilevel crossings of leads l1–l4 requires to use a large and complex-shaped terminal base, and therefore the space factor of the coil case is also decreased.

SUMMARY OF THE INVENTION

In view of the above-mentioned, the present invention was made to provide an engine igniting coil device which realizes electrical connections of primary and secondary sides of all coil units only by mounting the coil units in a coil case without soldering or electric welding.

Another object of the present invention is to provide an engine igniting coil device wherein terminals of primary coils of coil units mounted in a coil case and corresponding primary terminal pins arranged in a terminal coupler can be connected by means of lead elements arranged in a plane without crossing with each other on the terminal base.

DESCRIPTION OF THE PREFERRED EMBODIMENTS

An embodiment of the present invention will now be described in detail by way of example and with reference to the accompanying drawings.

Figure 1:
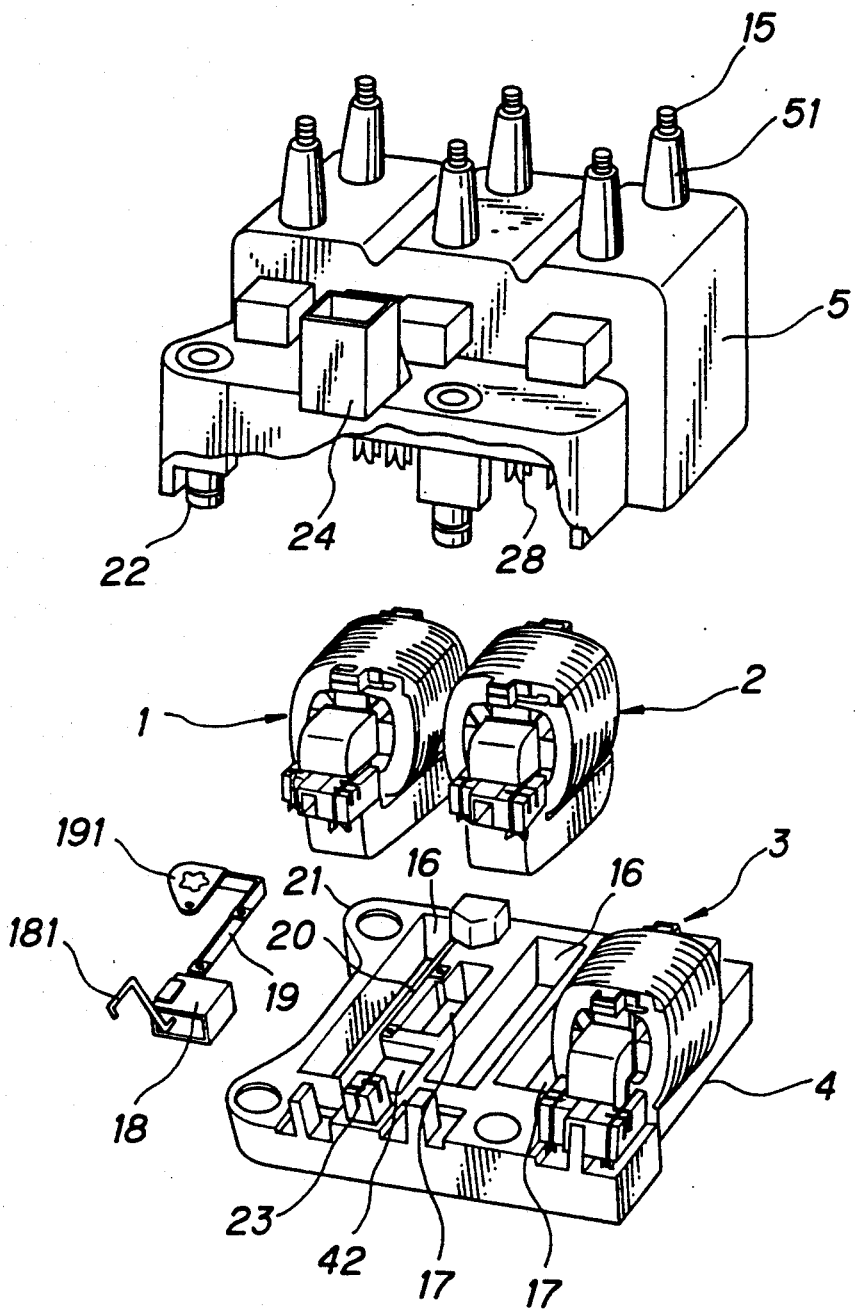
FIG. 1 is a perspective exploded view of an engine igniting coil device embodying the present invention.
Figure 2:
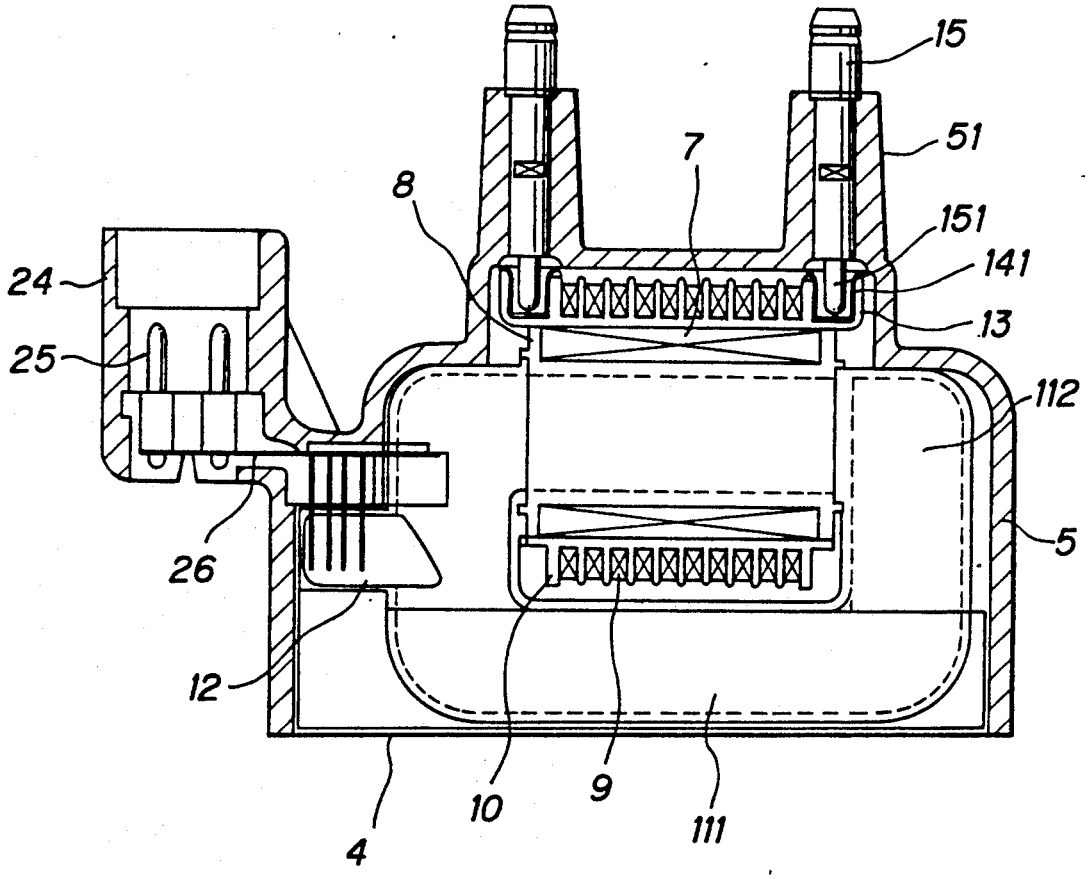
FIG. 2 is a sectional side view of the engine igniting coil device.

As shown in FIGS. 1 and 2. an engine igniting coil device according to the present invention comprises three coil units 1, 2 and 3 arranged in parallel to each other on a coil base 4, and a coil case 5 placed on the coil base and accommodating therein the coil units 1, 2 and 3, all of which is unitarily formed with insulating thermosetting resin, e.g. epoxy resin, injected to fill up the rest of the inner space of the coil case.

Figure 3:
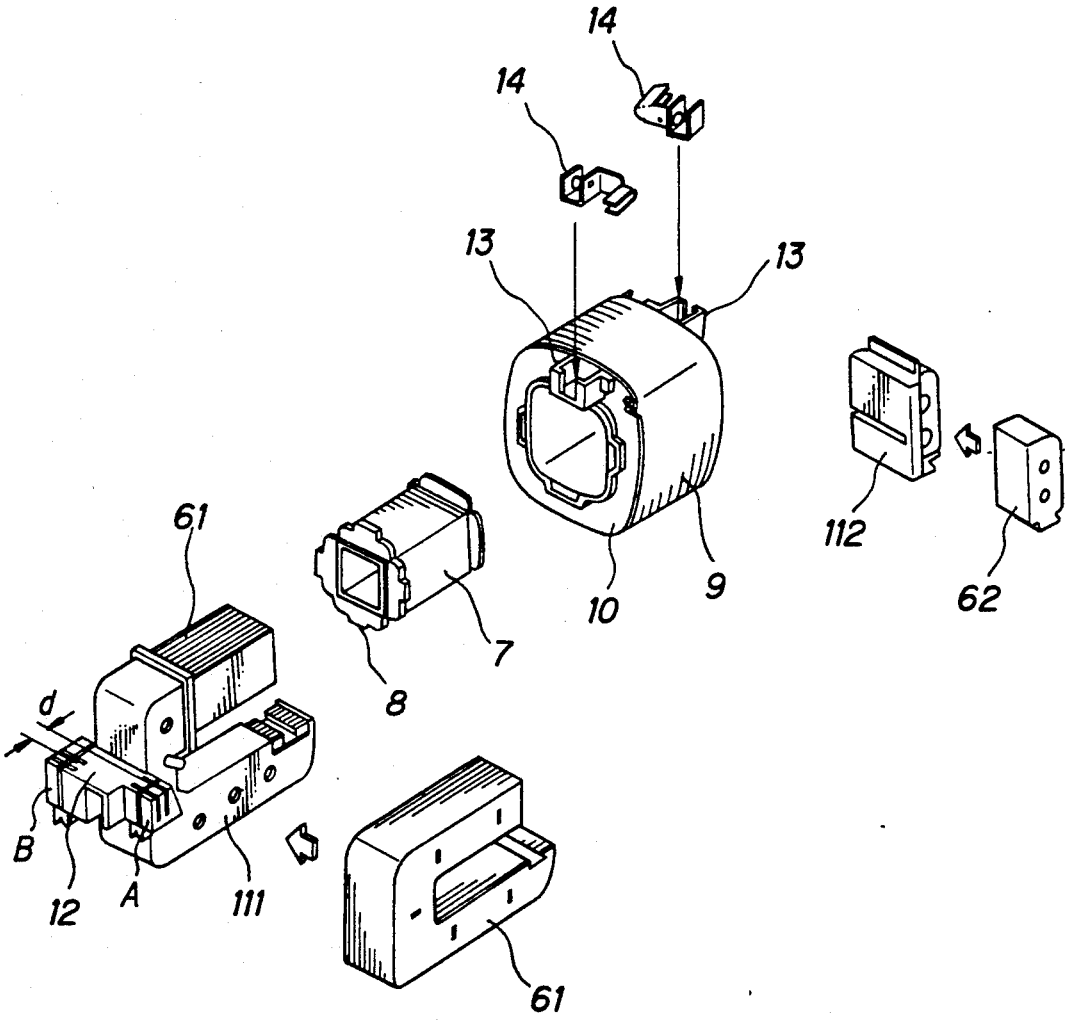
FIG. 3 is a perspective exploded view of a coil unit.

Each of coil units 1, 2 and 3 is constructed as shown in FIG. 3.

A primary side bobbin 8 with a primary coil 7 wound thereon is fitted onto an arm of a C-type core 61, and furthermore a secondary side bobbin 10 with a secondary coil 9 wounded thereon is fitted over the primary bobbin 8.

The C-type core 61 is housed in a core cover 111 in such a way that one of its arms may exposed out of the core cover for fitting thereon the primary side bobbin 8.

A I-type core 62 placed in a core cover 112 is fitted with pressure onto the open arm end of the C-type core to form a closed magnetic circuit type core.

The core covers 111 and 112 are molded of a relatively flexible resin, e.g. polypropylene, capable to absorb thermal distortion caused in the cores 61 and 62.

Since thus formed cores 62 and 63 of enclosed magnetic circuit type are covered with the primary side bobbin and the core covers 112 and 112, thermal stress caused by thermal expansion and shrinkage of the internal cores 62 and 63 can not transmitted to the surrounding resin portions which are therefore free from being cracked by the action of thermal stress.

Figure 4:
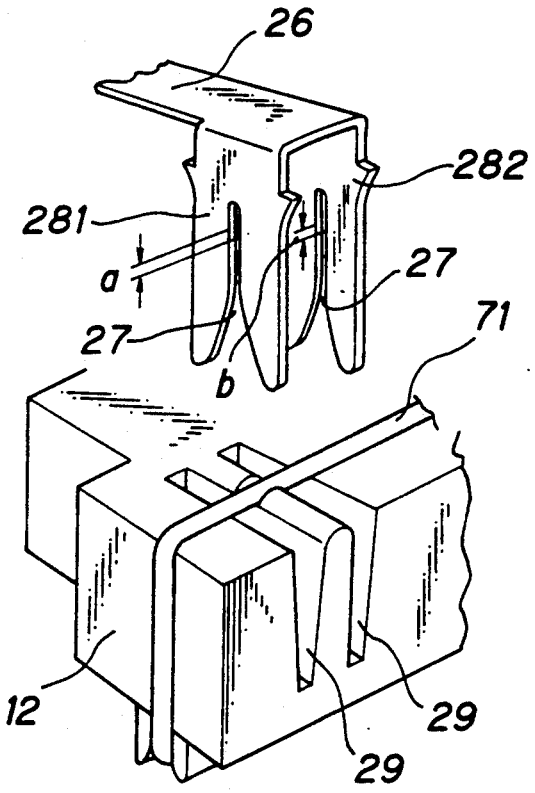
FIG. 4 is a fragmentary perspective view of a wire holder of a primary coil and of a forked end portion of a terminal plate connected to a primary terminal side.

As shown in FIG. 4, the core cover 111 has a wire holder 12 integrally formed at its end for fixing ends of wires brought-out from the primary and the secondary coils respectively.

Consequently, according to the present invention, there is no need to attach a separate wire holder 12, thereby making it easier to assemble the device. It is also becomes possible to arrange the wire holder possibly far apart from the secondary terminals attached to the both flanged sides of the secondary side bobbin 10.

Figures 5A, 5B:
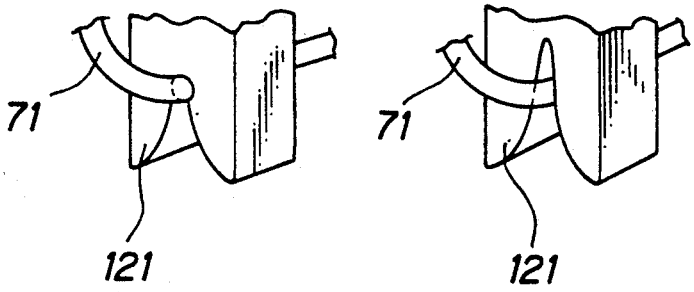
FIGS. 5 (*a*) and (*b*) show in perspective structures of wire stoppers.
Figure 6:
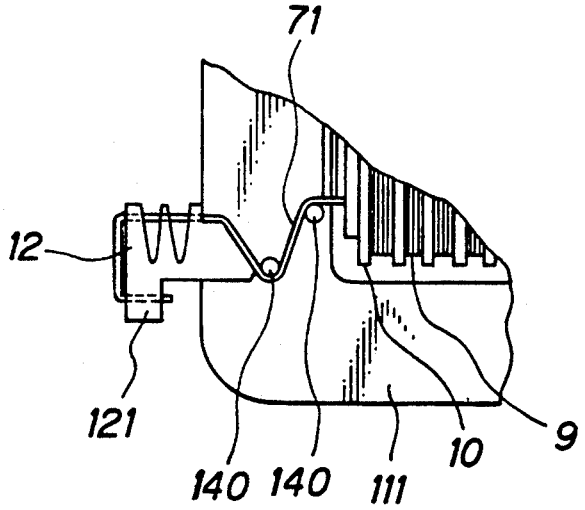
FIG. 6 is a fragmentary front view of a wire holder and and a wire guide.

As shown in FIGS. 4 and 6, the wire holder 12 has at its lower portion an integrally formed stopper 121 which is capable of flexibly holding the free end of the coil wire 71. FIGS. 5(*a*) and (*b*) illustrate, by way of example, groove shapes of the stopper portion 121 for catching therein a coil wire 71.

According to the present invention, it is possible to wind a coil wire brought-out from the primary coil 7 round the wire holder body and secure the wire end in the stopper portion 121. Thus the coil wire 71 can be easily secured and therefore assembling work of the device can be done efficiently.

Terminal holders 13 are provided one each at both flanged sides of the secondary side bobbin and each of them accommodates a secondary terminal 14.

Figure 9:
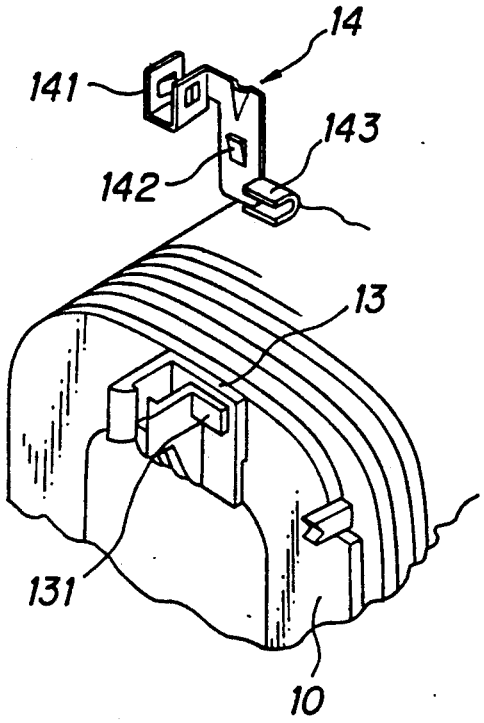
FIG. 9 a perspective view of a secondary terminal holder integrally provided at a secondary terminal and a secondary bobbin side.
Figure 10:
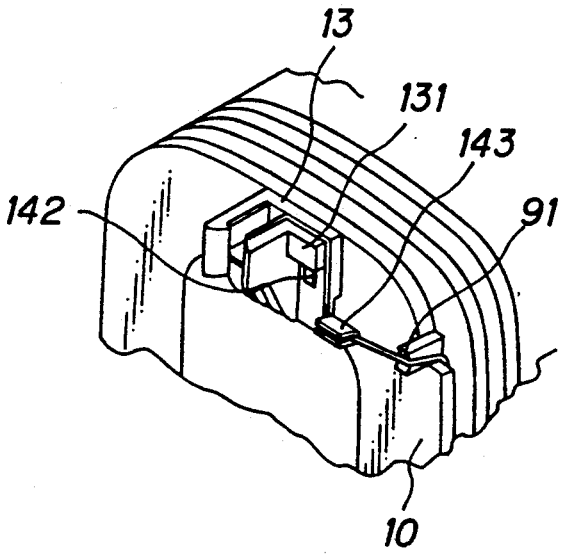
FIG. 10 is a perspective view of a secondary terminal mounted in a secondary terminal holder.

Each of secondary terminals 14, as shown in FIGS. 9 and 10, is locked at its lug portion 142 to a stepped portion of the terminal holder 131 when the secondary terminal 14 is inserted in the terminal holder 13.

Secondary terminal pins 15 are inserted with force in the coil case through corresponding bosses 51 of the coil case 5 in such a way so as to project their plug portions 151 in the case.

Figure 13:
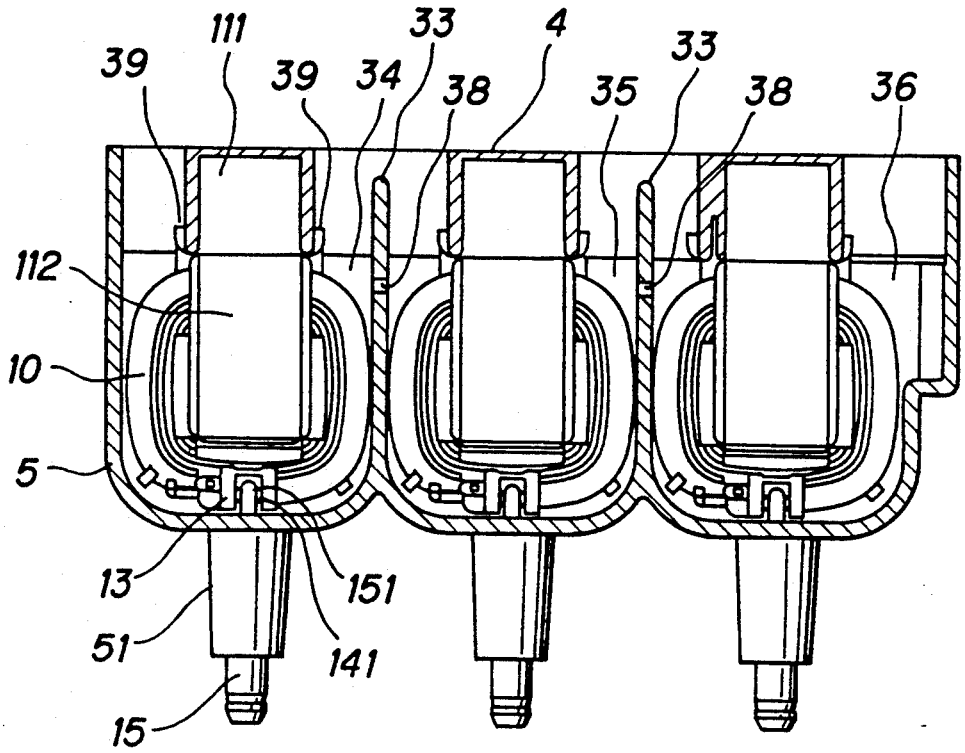
FIG. 13 illustrates in vertical elevation an engine igniting coil device.

Each secondary terminal 14 has an integrally formed socket portion 141 being resilient to cooperate with the plug portion 151 of the corresponding terminal pin 14, and electrical connections of coil units becomes to be effective when the plug portions 151 of the secondary terminal pins 15 are inserted into the socket potions 141 of the secondary terminals as shown in FIGS. 2 and 13.

Each secondary terminal 14 is provided with a connecting portion 143 whereto a lead wire 91 of the secondary coil 9 is attached by electric welding or the like method.

The coil base 4 has three grooved portions 16 for fitting therein the exposed portions of the core covers 111 of coil units 1, 2 and 3, that is, the coil units 1.2 and 3 are mounted in parallel to each other on the coil base.

The coil base 4 have also open ports 17 for injecting resin into the coil case 5.

As shown in FIG. 1, the coil base also incorporates a noise killer condenser 18 for preventing the ignition coil device from giving a noise to audio-visual apparatuses mounted in a vehicle.

An earthing plate 19 of the condenser 18 is placed in a clearance 20 formed in the coil base 4 and its connecting end 119 shaped in the form of an inner clip washer in placed on a collar mounting seat 21 of the coil base 4. When an electrically conductive collar 22 previously fitted in the coil base 4 is pressed in the seat 21, an electrical connection is made through the contact between the collar 22 and the connecting end 191 of the earthing plate 19. The collar 22 is hollow so as to pass an electrically conductive bolt for securing to the vehicle body, thereby earthing is made.

A positive side lead wire 181 of the condenser 18 is attached at its end to a wire holder 23 formed at the coil base 4.

A coupler 24 for the primary terminals is formed integrally at the coil case 5.

The coupler 24 incorporates four primary terminal pins corresponding to the coil units 1, 2 and 3, and terminal plates 26 as lead elements are attached one to each terminal pin. These terminal plates 26 are connected to corresponding coil wires from the primary coils of the coil units 1, 2 and 3.

As shown in FIG. 4, each terminal plate 26 has at its end a pair of connecting forks 28, each having two prongs forming therebetween a groove 27 which in its width at near bottom part is somewhat smaller than the diameter of the coil wire 71 to be fitted therein. An electrical connection can be set up between each terminal plate 26 and each coil wire 71 by thus fitting the coil wire 71 in the grooves 27 of two connecting forks 28 of the terminal plate 26.

Each wire holder 12 for each of the coil units 1, 2 and 3 has also two grooves and a coil wire taken from the corresponding primary coil 7 is secured to the wire holder 12 as being laid over two grooves.

Figure 7:
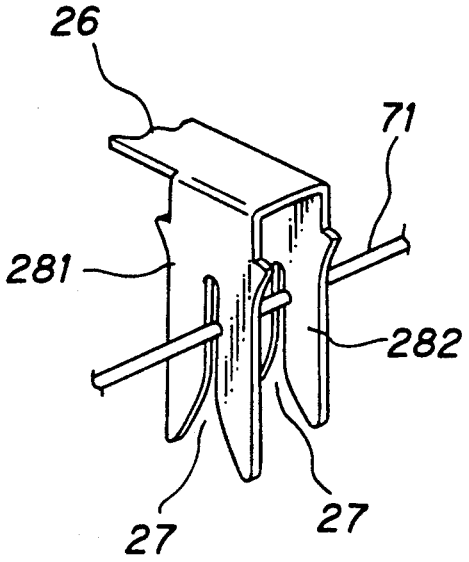
FIG. 7 show in perspective that forks of the terminal plate seize in its grooves a coil wire taken-out from the primary coil.

When the coil base 4 with the coil units 1, 2 and 3 arranged thereon is covered with the coil case 5, the paired of connecting forks 28 of the terminal plates 26 are inserted in the paired of groves 29 of the wire holders 12. At this time each of coil wires 71 secured to the corresponding wire holders 12 is forcibly fitted, as being stripped off, in the grooves 27 of the connecting forks 28 of the corresponding terminal plate 26 as shown in FIG. 7, thereby both sides are electrically connected with each other.

According to the present invention, in a pair of connecting forks 28, one fork 282 positioned at the inner side, i.e. at the primary coil side 7 has a cut groove 27 of width "a" larger than that "b" of the other fork 281 at the outer side.

Consequently, since a coil wire 71 is more forcibly seized in the outer fork 281 than in the inner fork 282, there may arise such a possibility that the wire 71 is cut off at the outer fork 281 when it expanded or shrank by the effect of heat. However, if the wire be broken at the outer fork 281, the electrical connection may be kept at the inner fork 281.

Figures 8A, 8B:
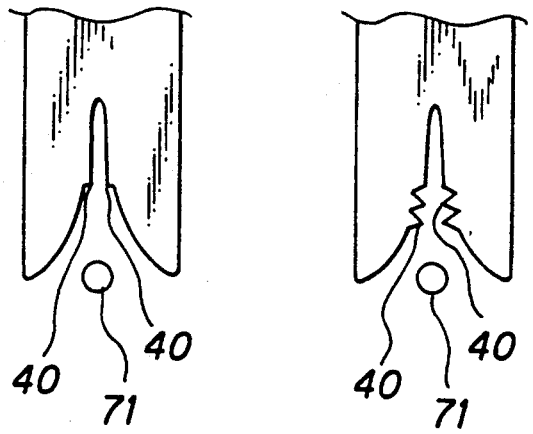
FIGS. 8 (*a*) and (*b*) shows, by way of example, the forked end portion of the terminal plate, each of which is provided with an edge for removing covering from the coil wire.

Furthermore, according to the present invention, each forked portion 28 has edges 40 formed inwardly at middle of the groove 27 between two prongs in order to previously removing covering from a part of the coil wire 71 to be seized in the groove as shown in FIGS. 8(*a*) and (*b*).

When the forked portions 28 are put on the coil wire, they can previously strip off the coil wire 71 by their edges 40 and then seize the exposed part of the wire in the bottoms of their grooves 27 to make electrical connections.

As shown in FIG. 6, the core cover 111 has wire guides 140 integrally formed therein for bending the coil wire 71 drawn-out from the primary coil 7.

Consequently, according to the present invention, since the coil wire 71 brought-out from the primary coil 7 is bent by guides 140 and then secured at its end to the wire holder 12, thermal distortion (expansion and shrinkage) of the wire can be absorbed by itself at its bent portion.

Accordingly, stress applied to the wire portions seized in the forked portions 28 of the terminal plate 26 can be also decreased enough to effectively avoid the thermal stress breakage of the wire thereat.

It may be allowed to provide such wire guides at the wire holder 12.

Figure 11A:
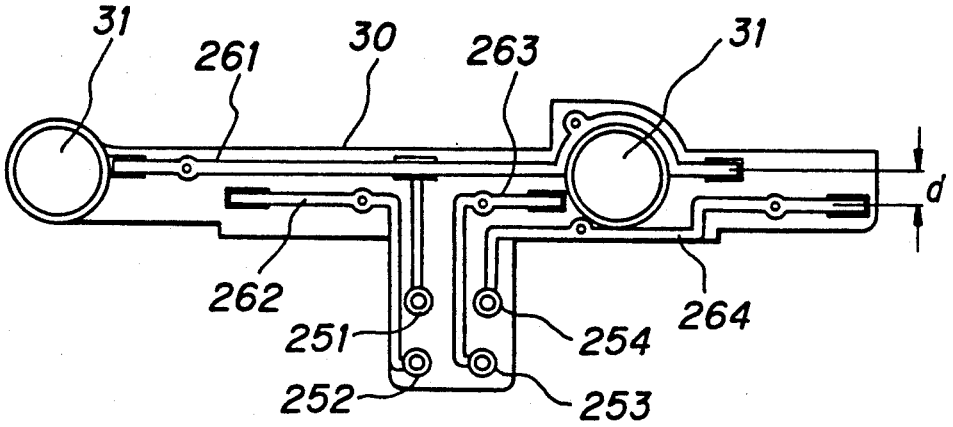
FIGS. 11 (*a*) and (*b*) are a plan view and a front view, respectively, of a terminal plate mounted on a terminal base.
Figure 11B:
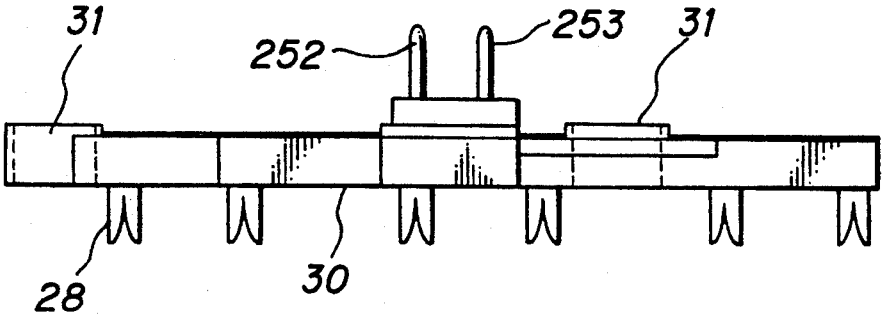

Four terminals pins 25 (251–254) and their terminal plates 26 (261–264) are arranged on the terminal base 30 as shown in FIGS. 11(*a*) and (*b*), wherein through holes 231 are also provided for insertion of collars 22. This terminal base 30 is incorporated in a given portion of the coil case 5.

Figure 12:
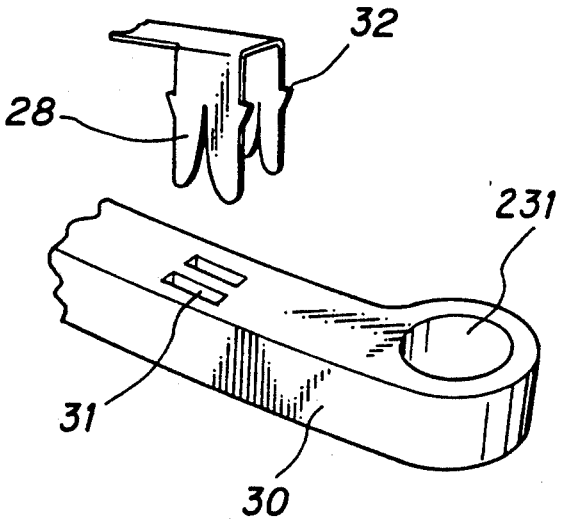
FIG. 12 is a perspective view of a forked end portion and a portion of terminal base.

As shown in FIG. 12, the terminal base 30 has pairs of through holes 31 for insertion of pairs of connecting forks 28 of the terminal plates 26. The forked portions 28 has protrusions 32 which engages with the bottom surface of the terminal base 30 to temporally secure the terminal plate 26 to the terminal base when the paired connecting forks 28 are inserted into the paired through holes 31 of the terminal base 30.

A terminal pin 251 and a terminal plate 261 connected to the terminal pin 251 are provided for positive (+) side common terminals of the coil units 1, 2 and 3. The terminal plate 261 for common terminals may be connected at the grooves 27 of its paired connecting forks 28 to a lead wire 181 of the condenser 18 to form an electrical connection therebetween in the same way as described above.

According to the present invention, such a provision is made that on the wire holder 12, a step "d" is provided between an inwardly positioned connecting part A of the common terminal wire from one side of the primary coil 7 and an outwardly positioned connecting part B of the wire from the other side of the primary coil 7 as shown in FIG. 3.

Correspondingly, on the terminal base, the terminal plate 261 for common terminals is arranged outwardly apart by a distance "d" from other terminal plates 262, 263, 264 so as to assure positioning the terminal plate 261 outwardly from the terminal pins 251–254.

Such arrangement makes it possible to mount the terminal plates 261–264. in one plane on the terminal base without crossing over them each other.

Figure 14:
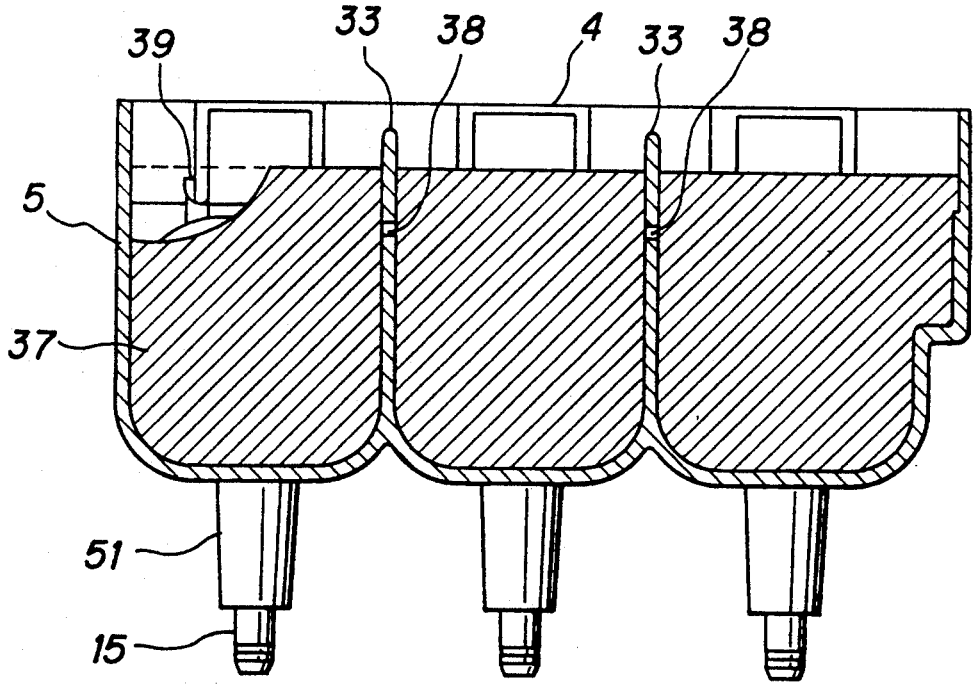
FIG. 14 is a vertical elevation of an engine igniting coil device when coil units are potted with resin in a coil case.
Figure 15:
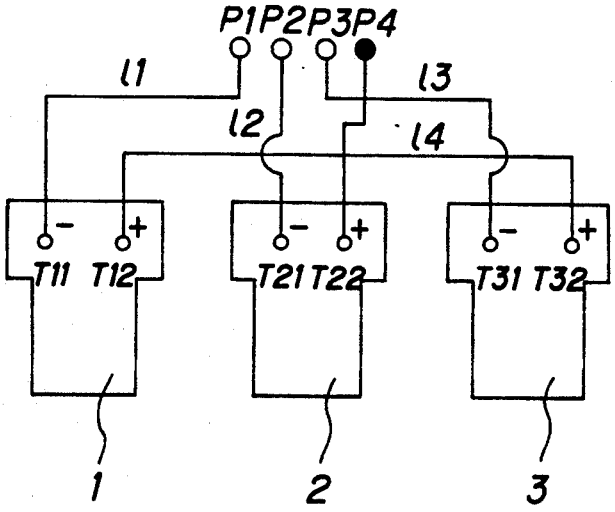
FIG. 15 is a schematic illustration of layout of lead elements for connection between primary terminal pins and coil units in prior art device.

Referring now to FIG. 13, an engine ignition coil device according to the present invention is constructed in such that three coil units 1, 2 and 3 are incorporated respectively in compartments 34, 35 and 36 separated from each other by partitions 33 integrally formed in the coil case 5. When the coil base 4 and the coil case 5 are assembled with each other as shown in FIG. 14, resin is injected into the separate compartments of the coil case 5 to unitarily form all components in one ignition coil device.

Such provision is also made that melt resin injected in the separate compartments 34, 35 and 36 may flow into the neighbor compartment through an open slit 38 formed in each partition 33, thereby levels of melt resin 37 in three compartments 34, 35 and 36 can become equal to each other.

The resin injecting ports are provided with protrusions 39 for indicating a control level of resin injection.

The melt resin is injected into the coil case 5 through the resin injection ports until the protrusions 39 in the injection ports just disappear in the melt resin injected.

As be apparent from the foregoing description, the engine igniting coil device according to the present invention is constructed in such a way that electrical connections of the primary and the secondary sides may be accomplished reliably at all positions only by mounting coil units in a coil case with no need of soldering or electric welding.

According to the present invention, since there is no need to provide dead spaces for carrying out soldering and electric welding as in prior art device, the coil case may be accordingly reduced in its size and weight.

According to the present invention, since the exposed portions of the cores are covered with core covers made of flexible resin, thermal stress caused by thermal expansion and shrinkage of the cores may be effectively absorbed by the cover, thereby surrounding resin portions effectively are protected against thermal stress cracking.

According to the present invention, since each core cover has an integrally formed thereon wire-holder with a resilient wire-stopper, each coil wire leading from a primary coil can be held in best condition on the wire holder.

According to the present invention, since wire guides are provided at each core cover or each wire holder-,each coil wire can be optimally held with a stress being absorbed at its bent portion along the guides.

According to the present invention, since terminal plates for connection to primary terminals are arranged in the same plane on a terminal base, in comparison with prior art device the terminal base itself can be made simple in shape and smaller in size with an increased space factor and the coil case can be accordingly reduced in its size.

What is claimed is:

1. An engine igniting coil device, comprising a plurality of coil units unitarily potted with insulating resin in a coil case including primary and secondary pins, characterized in that a forked connecting portion of each terminal plate connected to a said primary terminal pin and a plug portion of each said secondary terminal pin are exposed in the coil case, a wire holder for holding wires taken-out from both ends of a primary coil of each said coil unit is provided at each coil unit side and a secondary terminal having a socket whereto wires taken-out from both ends of a secondary coil of each said coil unit is connected is provided in such a way that when each said coil unit is mounted in the coil case, the terminal plate may seize at its forked ends the wires held on the wire holder, and the exposed plug portion of the secondary terminal pin may be inserted into the socket to form electrical connections at both the primary and the secondary sides of each coil unit.

2. An engine igniting coil device as claimed in claim 1, characterized in that the forked connecting portion has a pair of connecting forks, both forks have a groove which at its deep position is somewhat narrower than the wire diameter of the primary coil so as to make an electrical connection between the terminal plate and coil wire by seizing the wire in the grooves, and one fork arranged at the primary coil side is wider in its groove than the other fork arranged at outer side.

3. An engine igniting coil device as claimed in claim 2, characterized in that each said connecting fork has edges inwardly formed at its prongs for removing covering from the coil wire to be seized therein.

4. An engine igniting coil device as claimed in claim 1, characterized in that in each coil unit, said primary coil wound on a first bobbin is fitted on an arm of a closed magnetic circuit type core and furthermore said secondary coil wound on a second bobbin is fitted on the primary coil wound first bobbin, an exposed portion of the core is covered with a core cover of flexible resin which is provided with said wire holder integrally formed thereon for holding said coil wires taken-out from the primary coil.

5. An engine igniting coil device as claimed in claim 4, characterized in that the the wire holder is provided with a stopper portion for resiliently catching one of the coil wires taken-out from the primary coil.

6. An engine igniting coil device as claimed in claim 4, characterized in that the core cover has a a wire guide for bending one of the coil wires taken-out from the primary coil.

7. An engine igniting coil device as claimed in claim 1, characterized in that one of the primary terminal pins provides a common terminal of the primary coils of all coil units and all said primary terminal pins for all coil units are arranged in a group at an area on a terminal base and connected to the corresponding wire ends of the primary coils of the coil units by means of the respective terminal plates, and connections of the terminal plate with the common terminal of the primary coils of the coil units are arranged outwardly apart from connections of the terminal plates with other terminals of the primary coils of the coil units, thereby all terminal plates are arranged in a plane on the terminal base.

8. An engine igniting coil device as claimed in claim 4, characterized in that the wire holder has a wire guide for bending one of the coil wires taken-out from the primary coil.

* * * * *